US012421577B2

(12) United States Patent
Maruyama

(10) Patent No.: US 12,421,577 B2
(45) Date of Patent: Sep. 23, 2025

(54) ALUMINUM ALLOY FOR SLIDING COMPONENTS, AND SLIDING COMPONENT

(71) Applicant: Resonac Corporation, Tokyo (JP)

(72) Inventor: Takumi Maruyama, Kitakata (JP)

(73) Assignee: Resonac Corporation, Tokyo (JP)

( * ) Notice: Subject to any disclaimer, the term of this patent is extended or adjusted under 35 U.S.C. 154(b) by 371 days.

(21) Appl. No.: 18/031,024

(22) PCT Filed: Oct. 21, 2021

(86) PCT No.: PCT/JP2021/038944
§ 371 (c)(1),
(2) Date: Apr. 10, 2023

(87) PCT Pub. No.: WO2022/091936
PCT Pub. Date: May 5, 2022

(65) Prior Publication Data

US 2023/0374631 A1 Nov. 23, 2023

(30) Foreign Application Priority Data

Oct. 30, 2020 (JP) ..... 2020-182090

(51) Int. Cl.
*C22C 21/02* (2006.01)
*F04C 18/02* (2006.01)

(52) U.S. Cl.
CPC ..... *C22C 21/02* (2013.01); *F04C 18/0246* (2013.01); *F04C 2230/25* (2013.01)

(58) Field of Classification Search
CPC ..... C22C 21/02; C22C 21/04; C22F 1/043
See application file for complete search history.

(56) References Cited

FOREIGN PATENT DOCUMENTS

| | | | |
|---|---|---|---|
| CN | 108251715 | A | 7/2018 |
| EP | 3 950 985 | A1 | 2/2022 |
| JP | 08-028493 | A | 1/1996 |
| JP | 10-204566 | A | 8/1998 |
| JP | 2005-281742 | A | 10/2005 |
| JP | 2005-330560 | A | 12/2005 |
| JP | 2020-100863 | A | 7/2020 |
| JP | 2020-125525 | A | 8/2020 |
| JP | 2020-158844 | A | 10/2020 |
| WO | 2020/194906 | A1 | 10/2020 |

*Primary Examiner* — Jessee R Roe
(74) *Attorney, Agent, or Firm* — Sughrue Mion, PLLC

(57) ABSTRACT

An aluminum alloy for sliding components contains 8.0-11.5% by mass of Si, 0.7-1.2% by mass of Cu, 0.2-0.6% by mass of Mg, 0.30-0.60% by mass of Mn, 0.10-0.30% by mass of Fe, 0.01-0.03% by mass of Cr, and balance Al with inevitable impurities, in which a tensile strength at 25° C. is within a range of 330 MPa or more and 380 MPa or less, the aluminum alloy does not contain, per 1182 $\mu m^2$, two or more crystallized products containing 1% by mass or more of Cu and having a circle equivalent diameter exceeding 5 μm, and the aluminum alloy does not contain, per 1182 $\mu m^2$, two or more Cr-containing intermetallic compounds having a length of 8 μm or more, and does not contain, per 4726 $\mu m^2$, two or more primary crystal Si particles having a circle equivalent diameter exceeding 10 μm.

8 Claims, 2 Drawing Sheets

ALUMINUM ALLOY FOR SLIDING COMPONENTS, AND SLIDING COMPONENT

CROSS REFERENCE TO RELATED APPLICATIONS

This application is a National Stage of International Application No. PCT/JP2021/038944 filed on Oct. 21, 2021, claiming priority based on Japanese Patent Application No. 2020-182090 filed on Oct. 30, 2020.

TECHNICAL FIELD

The present invention relates to an aluminum alloy for sliding components, and a sliding component.

Priority is claimed on Japanese Patent Application No. 2020-182090, filed Oct. 30, 2020, the content of which is incorporated herein by reference.

BACKGROUND ART

Due to the recent demand for improved fuel efficiency in the automobile industry, various pans used in automobiles, such as compressors for automobile air conditioners, are required to be lighter and to have higher functionality. There are various types of compressors for air conditioners, and scroll compressors are widely used as compressors for automobile air conditioners.

A scroll compressor has a pair of spiral sliding components (scrolls), in which one sliding component (fixed scroll) is fixed and the other sliding component (orbiting scroll) is orbitally moved to reduce the volume of the space formed between the pair of sliding components, thereby generating compressed air. Sliding components used in such a scroll compressor are required to have excellent tensile strength and wear resistance during sliding. Further, sliding components of scroll compressors used for automobile air conditioners are also required to have excellent heat resistance such that the sliding components can be used in harsh environments with high temperatures.

In order to reduce the weight of the sliding components of scroll compressors, the material of the sliding components preferably has a high specific strength, which is the ratio of strength to weight. Therefore, aluminum alloys are generally used as materials for sliding components of scroll compressors. As aluminum alloys. Al—Si-based aluminum alloys are used from the viewpoint of tensile strength, wear resistance, and heat resistance. In addition, in order to improve the wear resistance of the sliding components, the surfaces of the sliding components are subjected to an anodizing treatment (anodized aluminum treatment) to form an anodized aluminum film with high hardness on the surfaces of the sliding components.

In order to improve the tensile strength of aluminum alloys, addition of metallic elements such as Cu and Mg to Al—Si-based aluminum alloys has been investigated (Patent Documents 1 and 2). However, it is known that, when additive metals such as Cu and Mg, especially Cu, am added at a high concentration to an aluminum alloy, the growth of the anodized aluminum film by anodizing treatment is inhibited and the anodized aluminum film formability deteriorates (Patent Document 3).

CITATION LIST

Patent Documents

Patent Document 1: Japanese Unexamined Patent Application, First Publication No. 2005-281742

Patent Document 2: Japanese Unexamined Patent Application. First Publication No. H8-28493

Patent Document 3: Japanese Unexamined Patent Application, First Publication No. 2005-330560

SUMMARY OF INVENTION

Technical Problem

In order to improve the tensile strength of aluminum alloys, it is effective to add metallic elements such as Cu and Mg to Al—Si-based aluminum alloys. However, there is a case that, when the amount of metallic elements added increases, coarse crystallized products and intermetallic compounds formed of two or more types of metals are formed in the aluminum alloy, and the tensile strength of the aluminum alloy may deteriorate and anodized aluminum film formability may deteriorate. Therefore, it is difficult to obtain an aluminum alloy that is excellent in both tensile strength and anodized aluminum film formability.

The present invention has been made in view of the above-mentioned technical background, and an object thereof is to provide an aluminum alloy for sliding components and a sliding component which are excellent in tensile strength and anodized aluminum film formability.

Solution to Problem

In order to achieve the above object, the present inventors have conducted intensive research and found that, by adding each element of Cu, Mg, Mn, Fe, and Cr in a specific amount to Al—Si-based aluminum alloys, it is possible to obtain an aluminum alloy having high tensile strength and containing a small mixed amount of coarse crystallized products and intermetallic compounds. Further, the present inventors have also confirmed that, in the aluminum alloy, it was possible to form an anodized aluminum film with high hardness on the surface thereof via anodizing treatment, and completed the present invention.

A first aspect of the present invention provides an aluminum alloy described in [1] below.

[1] An aluminum alloy for sliding components containing Si in a range of 8.0% by mass or more and 11.5% by mass or less, Cu in a range of 0.7% by mass or more and 1.2% by mass or less, Mg in a range of 0.2% by mass or more and 0.6% by mass or less. Mn in a range of 0.30% by mass or more and 0.60% by mass or less, Fe in a range of 0.10% by mass or more and 0.30% by mass or less, Cr in a range of 0.01% by mass or more and 0.03% by mass or less, and balance Al with inevitable impurities, in which a tensile strength at 25° C. is within a range of 330 MPa or more and 380 MPa or less, the aluminum alloy does not contain, per 1182 $\mu m^2$, two or more crystallized products containing 1% by mass or more of Cu and having a circle equivalent diameter exceeding 5 μm, and the aluminum alloy does not contain, per 1182 $\mu m^2$, two or more Cr-containing intermetallic compounds having a length of 8 μm or more, and the aluminum alloy does not contain, per 4726 $\mu m^2$, two or more primary crystal Si particles having a circle equivalent diameter exceeding 10 μm.

It is also preferable that the aluminum alloy contain Si in a range of 8.5% by mass or more and 10.5% by mass or less. Cu in a range of 0.8% by mass or more and 1.1% by mass or less, and Mg in a range of 0.4% by mass or more and 0.6% by mass or less.

A second aspect of the present invention provides a sliding component described in [2] below.

[2] A sliding component made of the aluminum alloy for sliding components according to [1] above.

The second aspect of the present invention preferably has the following features [3] to [7]. It is also preferable that two or more of these features be preferably combined.

[3] The sliding component according to [2] above, wherein the sliding component is a forged product.

[4] The sliding component according to [2] or [3] above, wherein the sliding component has an anodized aluminum film having a Vickers hardness of 400 HV or more as a surface thereof.

[5] The sliding component according to any one of [2] to [4] above, wherein the sliding component is a sliding component for compressors.

[6] The sliding component according to any one of [2] to [4] above, wherein the sliding component is a sliding component for scroll compressors.

[7] The sliding component according to any one of [2] to [4] above, wherein the sliding component is a sliding component for electric scroll compressors.

Advantageous Effects of Invention

According to the present invention, it is possible to provide an aluminum alloy for sliding components and a sliding component that are excellent in tensile strength and anodized aluminum film formability.

DESCRIPTION OF EMBODIMENTS

Figure 1:
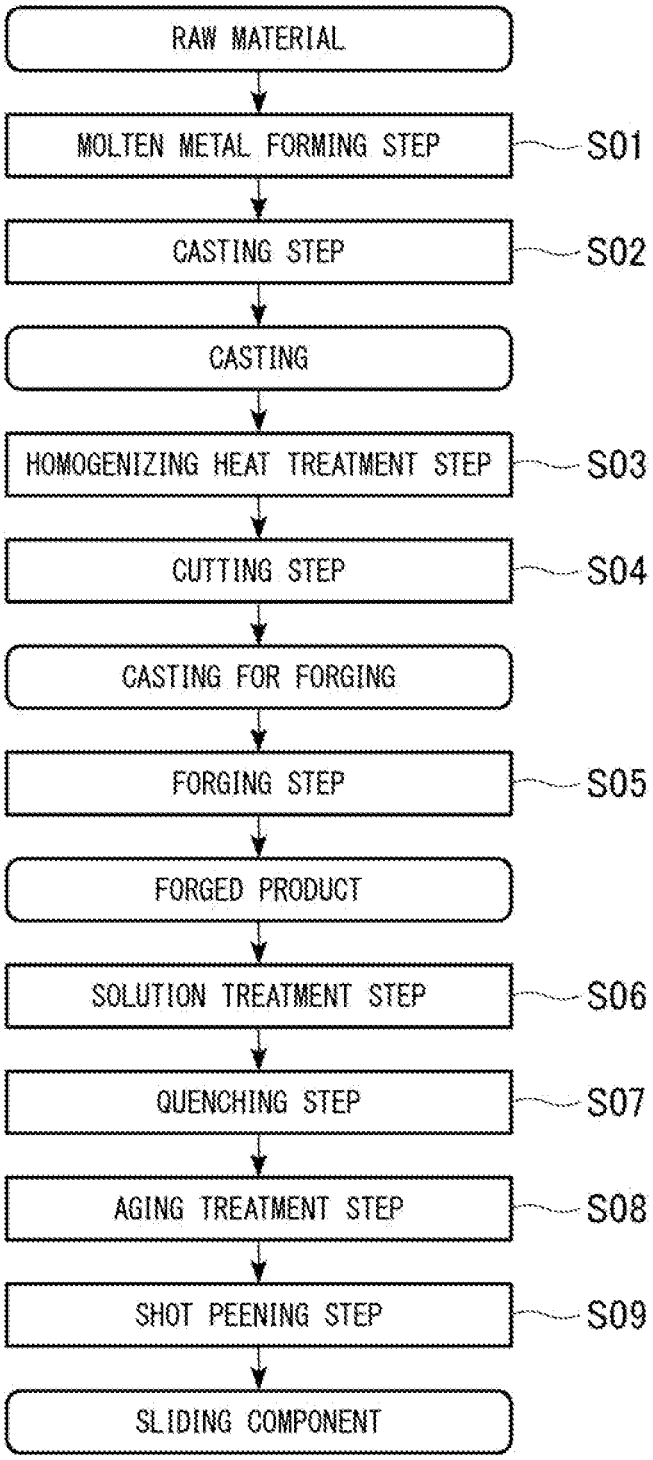
FIG. 1 is a flowchart showing an example of a method for manufacturing a sliding component according to one embodiment of the present invention.

Hereinafter, preferable examples of an aluminum alloy for sliding components and a sliding component according to one embodiment of the present invention will be described in detail.

In addition, in the drawings used in the following description, characteristic pans may be enlarged and schematically illustrated for convenience in order to make it easy to understand the features of the present invention, and the dimensional ratios of each configuration element may not necessarily be the same as actual ones.

The present embodiment is specifically described for better understanding of the gist of the invention, and does not limit the present invention unless otherwise specified. Numbers, materials, amounts, shapes, numerical values, ratios, positions, configurations, and the like may be changed, added, omitted, or replaced without departing from the scope of the present invention.

<Aluminum Alloy for Sliding Components>

The aluminum alloy for sliding components of the present embodiment contains Si in a range of 8.5% by mass or more and 10.5% by mass or less, Cu in a range of 0.8% by mass or more and 1.1% by mass or less, Mg in a range of 0.4% by mass or more and 0.6% by mass or less, Mn in a range of 0.30% by mass or more and 0.60% by mass or less, Fe in a range of 0.10% by mass or more and 0.30% by mass or less, Cr in a range of 0.01% by mass or more and 0.03% by mass or less, and balance Al with inevitable impurities. Further, the aluminum alloy for sliding components of the present embodiment may have a tensile strength of 330 MPa or more and 380 MPa or less at 25° C. Furthermore, the aluminum alloy for sliding components of the present embodiment does not contain, per 1182 $\mu m^2$, two or more crystallized products containing 1% by mass or more of Cu and having a circle equivalent diameter exceeding 5 μm, and the aluminum alloy does not contain, per 1182 $\mu m^2$, two or more Cr-containing intermetallic compounds having a length of 8 μm or more, and the aluminum alloy does not contain, per 4726 $\mu m^2$, two or more primary crystal Si particles having a circle equivalent diameter exceeding 10 μm.

(Si: 8.0% by Mass or More and 11.5% by Mass or Less)

Si (component) has the effect of improving the tensile strength of the aluminum alloy. However, when Si is excessively added to the aluminum alloy, there is a concern of decrease in the tensile strength of the aluminum alloy due to the crystallization of coarse primary crystal Si particles. In addition, the primary crystal Si particles may deteriorate anodized aluminum film formability.

When the Si content is less than 8.0% by mass, there is a concern of difficulty obtaining the effect of improving tensile strength by Si. On the other hand, when the Si content exceeds 11.5% by mass, there is a concern of coarse primary crystal Si particles being easily crystallized. For the above reasons, in the present embodiment, the Si content is in a range of 8.0% by mass or more and 11.5% by mass or less. The Si content is preferably in a range of 8.3% by mass or more and 11.0% by mass or less, more preferably in a range of 8.5% by mass or more and 10.5% by mass or less, and even more preferably in a range of 9.0% by mass or more and 10.0% by mass or less. Any Si content can be selected as long as the content is within the above range. For example, the content may be 8.00% by mass to 11.50% by mass, 8.10% by mass to 11.30% by mass, 8.50% by mass to 10.50% by mass, 8.70% by mass to 10.30% by mass, 8.90% by mass to 10.00% by mass, 9.20% by mass to 9.80% by mass, or 9.40% by mass to 9.60% by mass.

(Cu: 0.7% by Mass or More and 1.2% by Mass or Less)

Cu (component) has the effect of improving the tensile strength of the aluminum alloy. Cu forms a Guinier-Preston zone (G. P. zone) in aluminum alloys. A G. P. zone is an aggregate of solute atoms that appears in a matrix phase during aging of an age hardening alloy. This G. P. zone is an intermediate phase, which contributes to the improvement of the tensile strength of the aluminum alloy.

When the Cu content is less than 0.7% by mass, there is a concern of difficulty obtaining the effect of improving tensile strength by Cu. On the other hand, when the Cu content exceeds 1.2% by mass, there is a concern of deterioration of the anodized aluminum film formability. For the above reasons, in the present embodiment, the Cu content is in a range of 0.7% by mass or more and 1.2% by mass or less. The Cu content is preferably in a range of 0.8% by mass or more and 1.1% by mass or less, and more preferably in a range of 0.9% by mass or more and 1.0% by mass or less. Any Cu content can be selected as long as the content is within the above range. For example, the content may be 0.80% by mass to 1.10% by mass, 0.85% by mass to 1.05% by mass, 0.90% by mass to 1.00% by mass, or 0.93% by mass to 0.98% by mass.

(Mg: 0.2% by Mass or More and 0.6% by Mass or Less)

Mg (component) has the effect of improving the tensile strength of the aluminum alloy similarly to Cu. Mg forms compounds containing Si and/or Cu in aluminum alloys. This compound precipitates as a Q phase, thereby contributing to the improvement of the tensile strength of the aluminum alloy.

When the Mg content is less than 0.2% by mass, there is a concern of difficulty obtaining the effect of improving tensile strength by Mg. On the other hand, when the Mg content exceeds 0.6% by mass, there is a concern of deterioration of the effect of improving tensile strength by Mg. Therefore, in the present embodiment, the Mg content is set to be in a range of 0.2% by mass or more and 0.6% by mass or less. The Mg content is preferably in a range of 0.4% by mass or more and 0.6% by mass or less, and more preferably in a range of 0.45% by mass or more and 0.55% by mass or less. Any Mg content can be selected as long as the content is within the above range. For example, the content may be 0.40% by mass to 0.60% by mass, 0.43% by mass to 0.58% by mass, or 0.47% by mass to 0.53% by mass.

(Mn: 0.30% by Mass or More and 0.60% by Mass or Less)

Mn (component) has the effect of improving the tensile strength of the aluminum alloy. Mn forms fine granular crystallized products containing Al—Mn—Si intermetallic compounds and the like in aluminum alloys, thereby contributing to the improvement of the tensile strength of aluminum alloy.

When the Mn content is less than 0.30% by mass, there is a concern of difficulty obtaining the effect of improving tensile strength by Mn. On the other hand, when the Mn content exceeds 0.60% by mass, there is a concern of the intermetallic compound forming coarse crystallized products, which will deteriorate the tensile strength of the aluminum alloy. For the above reasons, in the present embodiment, the Mn content is in the range of 0.30% by mass or more and 0.60% by mass or less. The Mn content is preferably in a range of 0.35% by mass or more and 0.55% by mass or less. Any Mn content can be selected as long as the content is within the above range. For example, the content may be 0.38% by mass to 0.53% by mass, 0.40% by mass to 0.50% by mass, or 0.43% by mass to 0.47% by mass.

(Fc: 0.10% by Mass or More and 0.30% by Mass or Less)

Fe (component) has the effect of improving the tensile strength of the aluminum alloy. Fe crystallizes in the aluminum alloy as fine crystallized products including Al—Fe—Si intermetallic compounds, Al—Cu—Fe intermetallic compounds, Al—Mn—Fe intermetallic compounds, and the like, thereby contributing to the improvement of the mechanical properties of the aluminum alloy.

When the Fe content is less than 0.10% by mass, there is a concern of difficulty obtaining the effect of improving tensile strength by Fe. On the other hand, when the Fe content exceeds 0.30% by mass, there is a concern of the intermetallic compound forming coarse crystallized products, which will deteriorate the tensile strength of the aluminum alloy. For the above reasons, in the present embodiment, the Fe content is in the range of 0.10% by mass or more and 0.30% by mass or less. The Fe content is preferably in a range of 0.15% by mass or more and 0.25% by mass or less. Any Fe content can be selected as long as the content is within the above range. For example, the content may be 0.13% by mass to 0.27% by mass, or 0.17% by mass to 0.20% by mass.

(Cr: 0.01% by Mass or More and 0.03% by Mass or Less)

Cr (component) has the effect of improving the mechanical properties of the aluminum alloy. Cr crystallizes in the aluminum alloy as fine Cr-containing intermetallic compounds including Al—Fe—Cr intermetallic compounds and the like, thereby contributing to the improvement of the mechanical properties of the aluminum alloy.

When the Cr content is less than 0.01% by mass, there is a concern of difficulty obtaining the effect of improving tensile strength by Cr. On the other hand, when the Cr content exceeds 0.03% by mass, there is a concern of the Cr-containing intermetallic compound forming coarse crystallized products, which will deteriorate the tensile strength of the aluminum alloy. For the above reasons, in the present embodiment, the Cr content is in the range of 0.01% by mass or more and 0.03% by mass or less. The Cr content is preferably in a range of 0.015% by mass or mom and 0.02% by mass or less. Any Cr content can be selected as long as the content is within the above range. For example, the content may be 0.013% by mass to 0.028% by mass, 0.018% by mass to 0.026% by mass, or 0.020% by mass to 0.024% by mass.

(Inevitable Impurities)

The inevitable impurities are impurities that are inevitably mixed into the aluminum alloy from the raw material of the aluminum alloy or from the manufacturing process. In the aluminum alloy of the present embodiment, the mixed amount of each of the elements Zn, Ni, Zr, and Ti preferably does not exceed 0.5% by mass in terms of the total content of each of these elements. When the total content of each of the above elements exceeds 0.5% by mass, there is a concern of each element crystallizing before an Al matrix phase and forming coarse crystallized products, thereby reducing the ductility of the aluminum alloy and deteriorating tensile strength. Any amount of inevitable impurities can be selected as long as the content is within the above range. For example, the amount may be less than 0.50% by mass, 0.40% by mass or less, 0.30% by mass or less, 0.20% by mass or less, 0.10% by mass or less, 0.05% by mass or less, 0.01% by mass or less, or 0.001% by mass or less.

(Tensile Strength at 25° C.: Within a Range of 330 MPa or More and 380 MPa or Less)

The aluminum alloy of the present embodiment has a tensile strength in the range of 330 MPa or more and 380 MPa or less at 25° C. Tensile strength is a value measured in accordance with the provisions of JIS Z2241:2011 (metal material tensile test method) using a JIS No. 4 tensile test piece. Any tensile strength can be selected as long as the tensile strength is within the above range. For example, the tensile strength may be 340 MPa or more and 370 MPa or less, or 350 MPa or more and 360 MPa or less.

(Number of Crystallized Products Containing 1% by Mass or More of Cu and Having Circle Equivalent Diameter Exceeding 5 μm: Not More than Two Per 1182 $\mu m^2$)

When the circle equivalent diameter of the Cu-based crystallized products containing 1% by mass or more of Cu exceeds 5 μm, there is a concern of the formation of an anodized aluminum film by anodizing treatment being inhibited. Therefore, in the present embodiment, two or more coarse Cu-based crystallized products having a circle equivalent diameter exceeding 5 μm are not contained per 1182 $\mu m^2$. The number of coarse Cu-based crystallized products per 1182 $\mu m^2$ is preferably one or less, and more preferably, no coarse Cu-based crystallized products are contained. When the aluminum alloy does not contain coarse Cu-based crystallized products, the maximum circle equivalent diameter of the Cu-based crystallized products contained in the aluminum alloy is preferably 3 μm or less, and more preferably 1 μm or less.

The circle equivalent diameter and the number of Cu-based crystallized products can be measured, for example, by cutting an aluminum alloy and observing a range of 30.47 μm×38.97 μm (=1182 $\mu m^2$) of a cross section thereof using a field emission scanning electron microscope (FE-SEM)/energy dispersive X-ray spectrometer (EDS). That is, the measurement can be performed by performing elemental analysis using EDS, detecting Cu-based crystallized products containing 1% by mass or more of Cu, and by measuring the circle equivalent diameter and the number of the detected Cu-based crystallized products using SEM images. Examples of the crystallized products include, but are not limited to, Al—Cu—Mg—Si.

(Number of Cr-Containing Intermetallic Compounds Having Length of 8 μm or More: Not More than 2 Per 1182 $\mu m^2$)

In a Cr-containing intermetallic compound having a length of 8 μm or more, there is a concern of deterioration of the tensile strength of the aluminum alloy. Therefore, in the present embodiment, two or more coarse Cr-containing intermetallic compounds having a length of 8 μm or more are not contained per 1182 $\mu m^2$. The number of coarse Cr-containing intermetallic compounds per 1182 $\mu m^2$ is preferably one or less, and more preferably, no coarse Cr-containing intermetallic compounds are contained. When no coarse Cr-containing intermetallic compounds are contained, the maximum length of the Cr-containing intermetallic compound contained in the aluminum alloy is preferably 6 μm or less, and more preferably 4 μm or less.

Similar to the case of the above-described Cu-based crystallized product, the length and the number of the Cr-containing intermetallic compounds can be measured by detecting the Cr-containing intermetallic compounds by using FE-SEM/EDS for a range of 1182 $\mu m^2$ of the cross section of the aluminum alloy, and by measuring the length and the number of the detected Cr-containing intermetallic compounds using SEM images. Examples of the intermetallic compounds include, but are not limited to, Al—Cr—Si. The difference between the Cr-containing intermetallic compound and the Cu-based crystallized product is the shape of the intermetallic compound, or the like.

(Number of Primary Crystal Si Particles Having Circle Equivalent Diameter Exceeding 10 μm: Not More than Two Per 4726 $\mu m^2$)

In the case of coarse primary crystal Si particles having a circle equivalent diameter exceeding 10 μm, there is a concern of the formation of an anodized aluminum film by anodizing treatment being inhibited. Therefore, in the present embodiment, it is set that two or more coarse primary crystal Si particles having a circle equivalent diameter exceeding 10 μm are not contained per 4726 $\mu m^2$. The number of coarse primary crystal Si particles is preferably one or less, and more preferably, no coarse primary Si crystal particles are contained. When the aluminum alloy does not contain coarse primary crystal Si particles, the maximum circle equivalent diameter of the primary crystal Si particles contained in the aluminum alloy is preferably 8 μm or less, and more preferably 4 μm or less.

The circle equivalent diameter and the number of primary crystal Si particles can be measured by observing a range of 60.9 μm×77.6 μm (=4726 $\mu m^2$) of the cross section of the aluminum alloy using FE-SEM/EDS. Further, the primary crystal Si particles are made only of Si.

<Sliding Component>

The sliding component of the present embodiment is formed of the above-described aluminum alloy for sliding components of the present embodiment. The sliding component of the present embodiment may be a forged product.

In the sliding component of the present embodiment above, the surface may be provided with an anodized aluminum film having a Vickers hardness of 400 HV or more. An anodized aluminum film can be formed by an anodizing treatment. The film thickness of the anodized aluminum film is preferably in a range of 4 μm or more and 100 μm or less. The Vickers hardness of the anodized aluminum film is preferably in a range of 400 HV or more and 450 HV or less.

Next, a preferred example of the method for manufacturing a sliding component of the present embodiment will be described.

FIG. 1 is a flowchart showing an example of the method for manufacturing a sliding component according to the embodiment of the present invention. As shown in FIG. 1, the method for manufacturing a sliding component of the present embodiment includes a molten metal forming step S01 for obtaining a molten aluminum alloy, a casting step S02 for obtaining a casting by casting the molten metal, and a forging step SOS for obtaining a forged product by forging the casting. A homogenizing heat treatment step S03 and a cutting step S04 may be performed between the casting step S02 and the forging step S05. Moreover, after the forging step S05, a solution treatment step S06, a quenching step S07, an aging treatment step S08, and a shot peening step S09 may be performed.

(Molten Metal Forming Step S01)

In the molten metal forming step S01, a molten aluminum alloy is obtained by mixing the raw materials of Al source, Si source, Cu source, Mg source, Mn source, Fe source, and Cr source to have a composition that forms the above alloy, and heating and dissolving the obtained mixture at optionally selected temperature. Each of Al source. Si source, Cu source, Mg source, Mn source, Fe source, and Cr source may be a single metal material, or may be an alloy material containing two or more metals. Any temperature can be chosen as a temperature used to form the molten metal.

(Casting Step S02)

Figure 2:
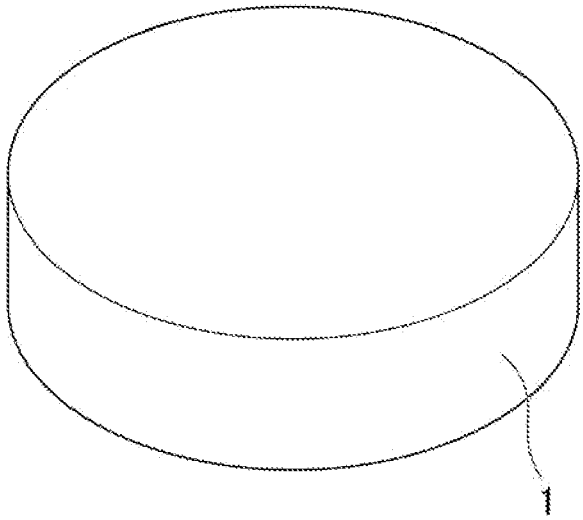
FIG. 2 is a schematic perspective view showing an example of an aluminum alloy for sliding components (casting) according to the embodiment of the present invention.

In the casting step S02, a casting 1 (first casting) is obtained by casting the molten aluminum alloy obtained in the molten metal forming step S01. FIG. 2 is a perspective view showing an example of an aluminum alloy for sliding components (casting) according to the embodiment of the present invention. In the casting step S02, it is preferable to obtain the cylindrical casting 1 as shown in FIG. 2. The casting method is not particularly limited. As the casting method, for example, known methods that have been conventionally used as aluminum alloy casting methods such as a continuous casting and rolling method, a hot top casting method, a float casting method, and a semi-continuous casting method (DC casting method) can be used. Due to this casting step, Mn forms fine granular crystallized products containing Al—Mn—Si intermetallic compounds. Further, Fe forms fine crystallized products such as Al—Fe—Si intermetallic compounds, Al—Cu—Fe intermetallic compounds, and Al—Mn—Fe intermetallic compounds. Further, Cr forms crystallized products as fine Cr-containing intermetallic compounds such as Al—Fe—Cr intermetallic compounds.

(Homogenizing Heat Treatment Step S03)

In the homogenizing heat treatment step S03, the casting 1 obtained in the casting step S02 and having, for example, a cylindrical shape, is subjected to homogenizing heat treatment. This homogenizing heat treatment eliminates the segregation of the additive elements that occurs during casting, homogenizes the composition, precipitates the supersaturated solid solution generated by solidification during casting, and further, changes a metastable phase formed by solidification during casting to an equilibrium phase. Any temperature can be selected as the heating temperature in the homogenizing heat treatment, but is, for example, within a range of 420° C. or higher and 500° C. or lower. If necessary, the temperature may be 430° C. or higher and 480° C. or lower, or 440° C. or higher and 460° C. or lower.

(Cutting Step S04)

In the cutting step S04, the cylindrical casting 1 subjected to the homogenizing heat treatment in the homogenizing heat treatment step S03 is cut into a predetermined size to obtain a casting which is used for forging. That is, in the cutting step S04, a casting which is used for forging is obtained by cutting the casting 1 along a plane. For example, thin cylindrical castings are obtained.

(Forging Step S05)

Figure 3:
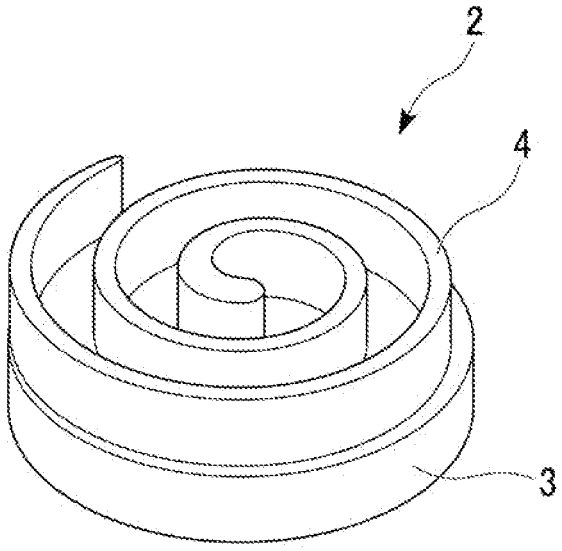
FIG. 3 is a schematic perspective view showing an example of a sliding component (forged product) according to the embodiment of the present invention.

In the forging step S05, forging is performed on the casting which is used for forging obtained in the cutting step S04 to obtain a forged product 2 (second casting) of a desired shape. FIG. 3 is a perspective view showing an example of the sliding component (forged product) according to the embodiment of the present invention. The forged product 2 shown in FIG. 3 is a sliding component (scroll) for a scroll compressor. The forged product 2 has a disk-shaped base portion 3 and a spiral projection portion 4. The forging method may be hot forging or cold forging. Any temperature can be selected as the heating temperature in the hot forging, but is, for example, within a range of 350° C. or higher and 450° C. or lower. If necessary, the temperature may be 370° C. or higher and 430° C. or lower, or 390° C. or higher and 420° C. or lower.

(Solution Treatment Step S06)

In the solution treatment step S06, the forged product 2 obtained in the forging step S05 is subjected to solution treatment. By this solution treatment, elements such as Si, Cu, and Mg in the forged product 2 are redissolved in the aluminum alloy to form a solid solution state. Any temperature can be selected as the heating temperature in the solution treatment, but is, for example, within a range of 450° C. or higher and 540° C. or lower. If necessary, the temperature may be 470° C. or higher and 530° C. or lower, or 490° C. or higher and 510° C. or lower.

(Quenching Step S07)

In the quenching step S07, the forged product 2 that has been put into a solid solution state in the solution treatment step S06 is quenched. This quenching treatment rapidly cools the forged product 2 to form a supersaturated solid solution in which the solid solution state is maintained.

Further, in the forging step S05, when the forging is performed by hot forging, forging and quenching, in which quenching is performed as it is after forging, may be performed by utilizing the heating during hot forging without performing the solution treatment step S06. Examples of the quenching treatment include water quenching.

(Aging Treatment Step S05)

In the aging treatment step S05, the forged product 2 made into a supersaturated solid solution in the quenching treatment step S07 is subjected to aging treatment. By this aging treatment, the forged product 2 is tempered at a low temperature. Due to this aging treatment, clusters are generated in the aluminum alloy that forms the forged product 2, and Cu is precipitated from these clusters as nuclei to form a G. P. zone. Moreover. Mg forms a compound with Si and/or Cu and precipitates as a Q phase. Any temperature can be selected as the heating temperature in the aging treatment, but is, for example, within a range of 150° C. or higher and 220° C. or lower. If necessary, the temperature may be 170° C. or higher and 200° C. or lower, or 180° C. or higher and 190° C. or lower. Any time can be selected as the heating time, but examples thereof include 0.5 hours to 20 hours and 1 hour to 16 hours.

(Shot Peening Step S09)

In the shot peening step S09, the forged product 2 subjected to the aging treatment in the aging treatment step S05 is cut by machining in order to smooth the surface and/or remove the unprocessed part, and then shot peening is performed to apply plastic working in the vicinity of the surface to improve the fatigue strength. The size of the abrasive grains used in shot peening, in which the abrasive grains collide with the alloy surface at high speed, is preferably 1 mm or less. As a material for the abrasive grains, for example, stainless steel (for example, SUS34), alumina, or the like can be used. Further, the peening pressure is preferably 1 MPa or less.

A sliding component (forged product) can be manufactured by the manufacturing method described above. In the obtained sliding component, the tensile strength at 25° C. is within the range of 330 MPa or more and 380 MPa or less, the sliding component does not contain, per 1182 $\mu m^2$, two or more crystallized products containing 1% by mass or more of Cu and having a circle equivalent diameter exceeding 5 μm, and the sliding component does not contain, per I182 $\mu m^2$, two or more Cr-containing intermetallic compounds having a length of 8 μm or more, and does not contain, per 4726 $\mu m^2$, two or more primary crystal Si particles having a circle equivalent diameter exceeding 10 μm. This sliding component is excellent in tensile strength and anodized aluminum film formability. Therefore, this sliding component can be formed with an anodized aluminum film having a Vickers hardness of 400 HV or more by anodizing treatment. A sliding component provided with an anodized aluminum film having a Vickers hardness of 400 HV or more on the surface has a further improved tensile strength and improved wear resistance.

The aluminum alloy for sliding components of the present embodiment having the above configuration contains each additive element of Si. Cu, Mg, Mn. Fe, and Cr within the above range, and the balance Al with inevitable impurities, a tensile strength at 25° C. is within a range of 330 MPa or more and 380 MPa or less, the aluminum alloy does not contain, per 1182 $\mu m^2$, two or more crystallized products containing 1% by mass or more of Cu and having a circle equivalent diameter exceeding 5 m, and the aluminum alloy does not contain, per 1182 $\mu m^2$, two or more Cr-containing intermetallic compounds having a length of 8 μm or more, and does not contain, per 4726 $\mu m^2$, two or more primary crystal Si particles having a circle equivalent diameter of more than 10 μm. Therefore, the aluminum alloy for sliding components is excellent in tensile strength and anodized aluminum film formability.

In addition, since the sliding component of the present embodiment is formed of the above aluminum alloy for sliding components, the sliding component is excellent in tensile strength and anodized aluminum film formability. In the sliding component of the present embodiment, when the sliding component is a forged product, the strength is further improved. Furthermore, in the sliding component of the present embodiment, when the surface is provided with an anodized aluminum film having a Vickers hardness of 400 HV or more, the strength is further improved and the wear resistance is improved.

The sliding component of the present embodiment can be suitably used as a sliding component for compressors (compressing apparatus). The forged product of the present embodiment can be advantageously used as a sliding component for a scroll compressor, particularly as a sliding component for an electric scroll compressor in which an orbiting scroll is driven by a motor.

In addition, the present invention is not necessarily limited to the above-described embodiments, and various modifications can be made without departing from the gist of the present invention.

EXAMPLES

Next, specific examples of the present invention will be described, but the present invention is not particularly limited to these examples.

Example 1

A casting (first casting) having a diameter of 82 mm was obtained by continuous casting of a molten aluminum alloy containing 10.0% by mass Si, 0.9% by mass Cu, 0.3% by mass Mg, 0.5% by mass Mn, 0.02% by mass Cr, 0.20% by mass Fe. and the balance Al. The obtained casting was subjected to homogenizing heat treatment, and then the casting was air-cooled. Next, the casting was then cut to a predetermined length to obtain a casting which is used for forging. The obtained casting was subjected to hot forging to obtain a forged product (second casting). The obtained forged product was subjected to solution treatment and then to water quenching. Next, the casting after the water quenching treatment was subjected to the aging treatment to obtain a forged product for sliding components.

Examples 2 and 3 and Comparative Examples 1 to 12

A forged product for sliding components was obtained in the same manner as in Example 1, except that the contents of Si, Cu, Mg, Mn, Cr, and Fe in the aluminum alloy were changed to the proportions shown in Table 1.

TABLE 1

| | Composition of aluminum alloy (% by mass) | | | | | | |
|---|---|---|---|---|---|---|---|
| | Si | Cu | Mg | Mn | Cr | Fe | Al |
| Example 1 | 10.0 | 0.9 | 0.3 | 0.5 | 0.02 | 0.20 | balance |
| Example 2 | 11.5 | 1.2 | 0.6 | 0.6 | 0.03 | 0.28 | balance |
| Example 3 | 8.2 | 0.7 | 0.2 | 0.3 | 0.01 | 0.12 | balance |
| Comparative Example 1 | 13.0 | 0.9 | 0.3 | 0.5 | 0.02 | 0.20 | balance |
| Comparative Example 2 | 7.3 | 0.9 | 0.3 | 0.5 | 0.02 | 0.20 | balance |
| Comparative Example 3 | 10.0 | 0.5 | 0.3 | 0.5 | 0.02 | 0.20 | balance |
| Comparative Example 4 | 10.0 | 1.4 | 0.3 | 0.5 | 0.02 | 0.20 | balance |
| Comparative Example 5 | 9.9 | 1.0 | 0.1 | 0.5 | 0.02 | 0.20 | balance |
| Comparative Example 6 | 9.9 | 1.0 | 1.0 | 0.5 | 0.02 | 0.20 | balance |
| Comparative Example 7 | 10.0 | 0.9 | 0.3 | 0.01 | 0.02 | 0.20 | balance |
| Comparative Example 8 | 10.0 | 0.9 | 0.3 | 0.9 | 0.02 | 0.20 | balance |
| Comparative Example 9 | 10.0 | 0.9 | 0.3 | 0.5 | 0.05 | 0.20 | balance |

TABLE 1-continued

| | Composition of aluminum alloy (% by mass) | | | | | | |
|---|---|---|---|---|---|---|---|
| | Si | Cu | Mg | Mn | Cr | Fe | Al |
| Comparative Example 10 | 10.0 | 0.9 | 0.3 | 0.5 | 0.003 | 0.20 | balance |
| Comparative Example 11 | 10.0 | 0.9 | 0.3 | 0.5 | 0.02 | 0.38 | balance |
| Comparative Example 12 | 10.0 | 0.9 | 0.3 | 0.5 | 0.02 | 0.07 | balance |

[Evaluation]

The forged products for sliding components obtained in Examples 1 to 3 and Comparative Example 1 to 12 were evaluated as follows.

<Composition>

The contents of the elements Si, Cu, Mg, Mn, Cr, and Fe in the forged product for sliding components were measured as follows. The forged product for sliding components are dissolved using acid hydrochloric acid and hydrogen peroxide. The content of each element in the resulting solution is measured using an ICP emission spectrometer, and the measured value is converted to the content of each element in the forged product.

As a result of this measurement, the contents of each element in the forged products obtained in each of the examples and the comparative examples were the same as the contents shown in Table 1.

<Structure Observation>

The structure of the forged products for sliding components was observed as follows.

The forged product for sliding components was cut into a predetermined size to prepare an observation sample. A surface parallel to a forging direction of the observation sample was machined to be an observation surface. The observation surface of the observation sample was observed using FE-SEM/EDS. The magnification of the FE-SEM was set to 3000 times, and an observation field of the FE-SEM (30.47 μm×38.79 μm=1182 $\mu m^2$) was subjected to element analysis using EDS to specify Cr-containing intermetallic compounds and Cu-based crystallized products containing 1% by mass or more of Cu. The circle equivalent diameter of the specified Cu-based crystallized products was calculated, and "the number of Cu-based crystallized products having a circle equivalent diameter exceeding 5 μm" and "the maximum circle equivalent diameter" were obtained. The length of the specified Cr-containing intermetallic compound was calculated, and "the number of Cr-containing intermetallic compounds having a length of 8 μm or more" and "maximum length" were obtained. In addition, the magnification of the FE-SEM was set to 1500 times, and the observation field of the FE-SEM (60.9 μm×77.6 μm=4726 $\mu m^2$) was subjected to elemental analysis using EDS to specify the primary crystal Si particles. The circle equivalent diameters of the specified primary crystal Si particles were calculated, and "the number of crystal Si particles having a circle equivalent diameter exceeding 10 μm" and "the maximum circle equivalent diameter" were obtained. Further, the observation of Cu-based crystallized products, Cr-containing intermetallic compounds, and primary crystal Si particles was performed on four observation surfaces. "The number of Cu-based crystallized products having a circle equivalent diameter exceeding 5 μm." "the number of Cr-containing intermetallic compounds having a length of 8 μm or more." and "the number of primary crystal Si particles having a circle equivalent diameter exceeding 10 μm" are the average values of the number measured within the observation surface thereof. In addition, the "maximum circle equivalent diameter" of the Cu-based crystallized product and of the primary crystal Si particles and the "maximum length" of the Cr-containing intermetallic compound are the maximum values measured within the observation surface thereof. The results are shown in Table 2.

<Tensile Strength>

The tensile strength of the forged product for sliding components was measured as follows.

The forged product for sliding components was cut into a predetermined size to prepare a JIS No. 4 tensile test piece. A tensile test was performed on the obtained JIS No. 4 tensile test piece in accordance with the provisions of JIS Z2241:2011 (metal material tensile test method), and the tensile strength (MPa) at 25° C. was measured.

The results are shown in Table 2. In Table 2, those with the tensile strength within the range of 330 MPa or more and 380 MPa or less are indicated as "○ (acceptable)," and those with the tensile strength deviating from the above range are indicated as "x (not acceptable)."

<Hardness of Anodized Aluminum Film>

A forged product for sliding components was anodized to form an anodized aluminum film having a thickness of 20 μm on the surface of the forged product. Then, the hardness of the obtained anodized aluminum film was measured.

An anodized aluminum film was formed as follows. The forged product is immersed in an electrolytic solution having a concentration of free sulfuric acid of 150 g/L and a liquid temperature of 5° C. Then, using the forged product as an anode, a current with a current density of 3 A/dm$^2$ is applied to form an anodized aluminum film on the surface of the forged product. Then, the forged product on which the anodized aluminum film is formed is taken out from the electrolytic solution, and the anodized aluminum film is mirror-finished by buffing.

The hardness of the anodized aluminum film was measured as follows. The hardness of the anodized aluminum film is measured using a Vickers hardness tester. The hardness measurement is carried out in a thickness direction of the anodized aluminum film with a load of 0.01 g.

Table 2 shows the measurement results. In Table 2, those with a Vickers hardness of less than 400 HV were indicated as "x (not acceptable)." and those with a Vickers hardness of 400 HV or more were indicated as "○ (acceptable)."

<Overall Evaluation>

For those with a tensile strength of "○ (acceptable)" and a hardness of the anodized aluminum film of "○ (acceptable)," the overall evaluation will be indicated as pass ("○"). When either one of the tensile strength and the hardness of the anodized aluminum film was "x (not acceptable)," the overall evaluation will be indicated as failure ("x"). The results are shown in Table 2.

TABLE 2

| | Cu-based crystallized product | | Cr-containing intermetallic compound | | Primary crystal Si particles |
|---|---|---|---|---|---|
| | Number of Cu-based crystallized products having circle equivalent diameter exceeding 5 μm (number/1182 μm$^2$) | Maximum circle equivalent diameter (μm) | Number of Cr-containing intermetallic compounds having length of 8 μm or more (number/1182 μm$^2$) | Maximum length (μm) | Number of primary crystal Si particles having circle equivalent diameter exceeding 10 μm (number/4726 μm$^2$) |
| Example 1 | 0 | 0.2 | 0 | 5.3 | Not detected |
| Example 2 | 0 | 0.4 | 0 | 4.7 | Not detected |
| Example 3 | 0 | 0.2 | 0 | 1.8 | Not detected |
| Comparative Example 1 | 0 | 0.2 | 0 | 3.3 | 2 |
| Comparative Example 2 | 0 | 0.2 | 0 | 4.5 | Not detected |
| Comparative Example 3 | 0 | 0.1 | 0 | 3.9 | Not detected |
| Comparative Example 4 | 2 | 5.4 | 0 | 6.6 | Not detected |
| Comparative Example 5 | 0 | 0.3 | 0 | 5.0 | Not detected |
| Comparative Example 6 | 0 | 0.2 | 0 | 5.2 | Not detected |
| Comparative Example 7 | 0 | 0.3 | 0 | 3.6 | Not detected |
| Comparative Example 8 | 0 | 0.2 | 0 | 3.9 | Not detected |
| Comparative Example 9 | 0 | 0.2 | 2 | 8.8 | Not detected |
| Comparative Example 10 | 0 | 0.2 | 0 | 0.9 | Not detected |
| Comparative Example 11 | 0 | 0.4 | 0 | 9.3 | Not detected |
| Comparative Example 12 | 0 | 0.2 | 0 | 4.2 | Not detected |

TABLE 2-continued

| | Primary crystal Si particles Maximum circle equivalent diameter (μm) | Tensile properties Measured value (MPa) | Tensile properties Evaluation | Anodized aluminum film Vickers hardness (HV) | Anodized aluminum film Evaluation | Overall evaluation |
|---|---|---|---|---|---|---|
| Example 1 | Not detected | 351 | ○ | 430 | ○ | ○ |
| Example 2 | Not detected | 362 | ○ | 412 | ○ | ○ |
| Example 3 | Not detected | 331 | ○ | 444 | ○ | ○ |
| Comparative Example 1 | 18 | 350 | ○ | 389 | X | X |
| Comparative Example 2 | Not detected | 325 | X | 440 | ○ | X |
| Comparative Example 3 | Not detected | 319 | ○ | 453 | X | X |
| Comparative Example 4 | Not detected | 365 | X | 393 | ○ | X |
| Comparative Example 5 | Not detected | 314 | X | 441 | ○ | X |
| Comparative Example 6 | Not detected | 323 | X | 423 | ○ | X |
| Comparative Example 7 | Not detected | 302 | X | 436 | ○ | X |
| Comparative Example 8 | Not detected | 322 | X | 421 | ○ | X |
| Comparative Example 9 | Not detected | 305 | X | 415 | ○ | X |
| Comparative Example 10 | Not detected | 324 | X | 422 | ○ | X |
| Comparative Example 11 | Not detected | 323 | X | 414 | ○ | X |
| Comparative Example 12 | Not detected | 329 | X | 419 | ○ | X |

Front the results in Table 2, it was confirmed that the forged products of Examples 1 to 3, in which the contents of each additive element of Si, Cu, Mg, Mn, Fe, and Cr and the mixed amount of the precipitates such as the crystallized products containing 1% by mass or more of Cu, the Cr-containing intermetallic compounds, and the primary crystal Si particles were within the range of the present invention, were excellent in both of the tensile strength and the hardness of the anodized aluminum film. On the other hand, in Comparative Examples 1 to 12 in which the contents of each element added and the amount of mixed precipitates are out of the scope of the present invention, at least one characteristic of the tensile strength and the hardness of the anodized aluminum film was insufficient.

INDUSTRIAL APPLICABILITY

The present invention provides an aluminum alloy for sliding components and a sliding component that are excellent in tensile strength and anodized aluminum film formability.

The sliding components formed of the aluminum alloy for sliding components according to the present invention can be suitably used as sliding components for compressors (compressing apparatus) for automobile air conditioners, especially sliding components for scroll compressors and electric scroll compressors.

REFERENCE SIGNS LIST

1 Casting
2 Forged product
3 Base portion
4 Projection portion

The invention claimed is:

1. An aluminum alloy for sliding components containing Si in a range of 8.0% by mass or more and 11.5% by mass or less, Cu in a range of 0.7% by mass or more and 1.2% by mass or less, Mg in a range of 0.2% by mass or more and 0.6% by mass or less, Mn in a range of 0.30% by mass or more and 0.60% by mass or less, Fe in a range of 0.10% by mass or more and 0.30% by mass or less, Cr in a range of 0.01% by mass or more and 0.03% by mass or less, and balance Al with inevitable impurities, wherein a tensile strength at 25° C. is within a range of 330 MPa or more and 380 MPa or less, the aluminum alloy does not contain, per 1182 $\mu m^2$, two or more crystallized products containing 1% by mass or more of Cu and having a circle equivalent diameter exceeding 5 μm, and the aluminum alloy does not contain, per 1182 $\mu m^2$, two or more Cr-containing intermetallic compounds having a length of 8 μm or more, and the aluminum alloy does not contain, per 4726 $\mu m^2$, two or more primary crystal Si particles having a circle equivalent diameter exceeding 10 μm.

2. The aluminum alloy for sliding components according to claim 1, wherein the aluminum alloy contains Si in a range of 8.5% by mass or more and 10.5% by mass or less, Cu in a range of 0.8% by mass or more and 1.1% by mass or less, and Mg in a range of 0.4% by mass or more and 0.6% by mass or less.

3. A sliding component made of the aluminum alloy for sliding components according to claim 1.

4. The sliding component according to claim 3, wherein the sliding component is a forged product.

5. The sliding component according to claim 3, wherein the sliding component has an anodized aluminum film having a Vickers hardness of 400 HV or more as a surface thereof.

6. The sliding component according to claim 3, wherein the sliding component is a sliding component for compressors.

7. The sliding component according to claim 3, wherein the sliding component is a sliding component for scroll compressors.

8. The sliding component according to claim 3, wherein the sliding component is a sliding component for electric scroll compressors.

* * * * *